United States Patent [19]

McWhorter

[11] 4,414,823

[45] Nov. 15, 1983

[54] CRYOGENIC FREEZER

[75] Inventor: Thomas E. McWhorter, Whitehall, Pa.

[73] Assignee: Air Products and Chemicals, Inc., Allentown, Pa.

[21] Appl. No.: 341,351

[22] Filed: Jan. 21, 1982

Related U.S. Application Data

[63] Continuation-in-part of Ser. No. 130,905, Mar. 17, 1980, Pat. No. 4,312,156.

[51] Int. Cl.[3] ..... F25D 23/02

[52] U.S. Cl. ..... 62/266; 62/374; 62/380

[58] Field of Search ..... 62/63, 266, 374, 375, 62/380

[56] References Cited

U.S. PATENT DOCUMENTS

| | | | |
|---|---|---|---|
| Re. 28,712 | 2/1976 | Klee | 62/216 |
| 3,385,075 | 5/1968 | Casale | 62/63 |
| 3,403,527 | 10/1968 | Berreth et al. | 62/266 |
| 3,485,055 | 12/1969 | Webster et al. | 62/63 |
| 3,583,171 | 6/1971 | Flynn et al. | 62/266 |
| 3,605,434 | 9/1971 | Boese | 62/380 |
| 3,613,386 | 10/1971 | Klee | 62/64 |
| 3,635,045 | 1/1972 | Astrom | 62/374 |
| 3,728,869 | 4/1973 | Schmidt | 62/380 |
| 3,813,895 | 6/1974 | Klee et al. | 62/266 |
| 3,871,185 | 3/1975 | Harper et al. | 62/63 |
| 3,892,104 | 7/1975 | Klee et al. | 62/186 |
| 4,175,396 | 11/1979 | Miller et al. | 62/63 |

*Primary Examiner*—Ronald C. Capossela

*Attorney, Agent, or Firm*—Richard A. Dannells, Jr.; E. Eugene Innis; James C. Simmons

[57] ABSTRACT

This invention is directed to an apparatus for freezing an article under cryogenic conditions which comprises a housing encompassing an entry port, a freezing station, an exit station and an exit port being at a greater vertical elevation than the entry port and freezing station. In connection with the housing, there are means provided for transporting the article to be frozen sequentially from the entry port, entry station, through the freezing station, and then to the exit station, preferably at a rate of travel which increases as the article is being transported through the exit station. A connection is made to the housing permitting the introduction of a cryogen into the freezing station thereby maintaining such station at a cryogenic temperature.

8 Claims, 2 Drawing Figures

CRYOGENIC FREEZER

This application is a continuation-in-part application of copending application Ser. No. 130,905 filed Mar. 17, 1980, now U.S. Pat. No. 4,312,156, issued Jan. 26, 1982.

The present invention is directed to a cryogenic freezing apparatus. More particularly, this invention is directed to a tunnel-type cryogenic freezer specifically adapted for countercurrent flow of cryogen without the use of fans, control systems and other elaborate equipment.

The apparatus of the present invention also prevents the tendency of warm moist air to enter the freezing system during shut-down periods.

Cryogenic freezers of the tunnel-type have been described in the following U.S. Pat. Nos. Casale, 3,385,075, Berreth et al., 3,403,527; Flynn et al., 3,583,171; Klee et al., 3,613,386; Klee Re. 28,712; Klee et al., 3,813,895; Klee et al., 3,892,104; Miller, 4,175,396; and Harper et al., 3,871,185. The Miller and Harper et al. references are examples of types of freezers over which the freezer of the present invention is an improvement. The gas lock of the freezer of the Miller reference can be eliminated by use of the freezer of this invention. The freezer of Harper et al. reference requires the auxiliary equipment including an entire gas recirculation system to achieve the desired flow of cryogen vapor from the exit end to the entrance end which are on the same elevation, which equipment can also be eliminated in the freezer of the present invention.

SUMMARY OF THE PRESENT INVENTION

This invention is directed to an apparatus for cryogenically freezing an article which comprises a housing encompassing an entry port, a freezing station, an exit station and an exit port communicating between the exit station and the exterior of the housing. The exit port is positioned at a greater vertical elevation than the entry port and the freezing station. In connection with the housing, there are means provided for transporting an article to be frozen sequentially from the entry port, through the freezing station and exit station to the exit port. A connection is made to the housing permitting the introduction of a cryogen into the freezing station thereby maintaining such station at a cryogenic temperature. The means for transporting an article to be frozen is designed to increase the rate of speed of the article traveling through said exit station.

In one embodiment of this inventive apparatus the housing also contains an entry station with the entry port communicating between such an entry station and the exterior of the housing. The conformation and relative locations of the entry and exit ports and the freezing stations are such that the freezing station is positioned intermediate the entry station and exit station and is also located at a lower elevation than the entry port and exit port. This conformation of the apparatus creates a "well" for containing the cryogen within the apparatus and particularly in the freezing station. The fact that the entry port and exit port are both located at a higher elevation than is the freezing station and the exit port is located at a higher elevation than is the entry port establishes that the cryogen injected into the apparatus will first fill the freezing station and thereafter will rise within the apparatus until an avenue of escape is found. In the present apparatus, the first avenue of escape found by the rising cryogen will be at the entry port. This tends to establish a situation wherein cryogen injected into the apparatus will seek to escape via the lower level port, i.e. the entry port, while the movement of articles to be frozen from the entry station, through the freezing station and to the exit station creates somewhat of a mechanical sweeping action urging the cryogen away from the entry port. These offsetting actions tend to compensate each other. If the difference in elevation is sufficient, countercurrent flow of the cryogen relative to the movement of the articles can be established.

It is also been found that another benefit of having the entry port at a lower elevation than that of the exit port and having the entry and exit ports both at a higher elevation than the freezing zone is that when the freezer is shut down for any reason, the cold, very dry gas remains in the freezing zone as it slowly warms to ambient temperature. Contrary to that which occurs when at least the entry port is on the same level as the prior art freezers, warm moist air enters the freezing zone when it is shut down and the moisture condenses on the equipment which then tends to freeze up when operation resumes. This presents a constant source of problems in operating such prior art equipment.

The particular means for transporting the article to be frozen in the apparatus of this invention preferably comprises a combination of a low speed conveyor for transporting the article from the entry port through the freezing section and a high speed conveyor for transporting the article through the exit station to the exit port. The conveyors can be provided with flights or a bucket elevator can be used to prevent unwanted sliding movement as the article is transported in the entry and exit stations. The preferred combination is designed to minimize warm-up of the frozen article as it passes through the warm zone established in the exit station at a vertical elevation above that of the entry port. Therefore, by slowly transporting the article through the entry and freezing stations, the articles reach the desired frozen state and remain in such a state as they are swiftly transported through the exit station. The transition between the ends of the low and high speed conveyors within the freezing station may be made smoother by providing a ramp or a third conveyor or other means known in the art so that there is no tendency for the articles to be disoriented upon falling between the low and higher speed conveyors.

In order to describe this invention in greater detail reference is made to the attached drawings.

DETAILED DESCRIPTION OF THE DRAWINGS

Figure 1:
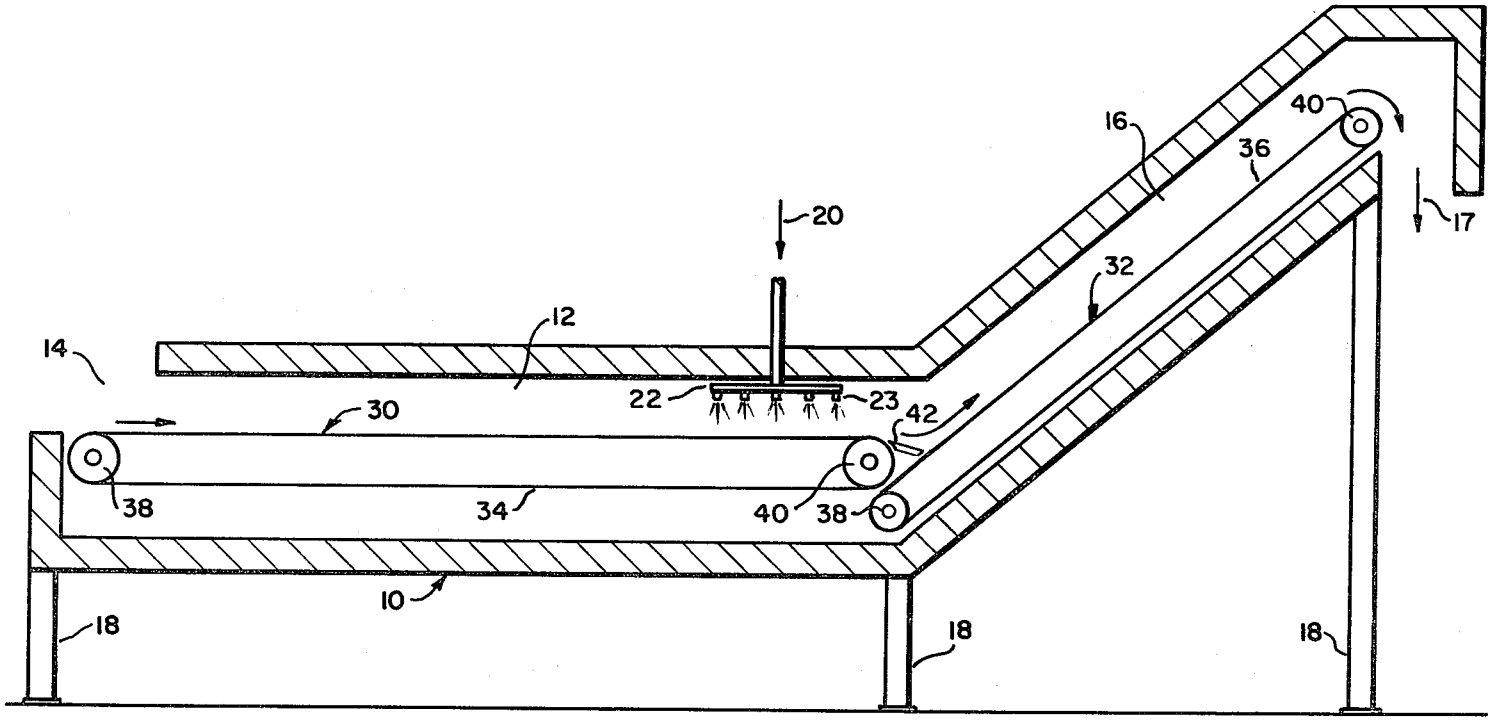
FIG. 1 is a side view of one embodiment of an apparatus of the present invention.

Referring now to FIG. 1, there can be seen a side view of the embodiment of an apparatus of this invention suitable for freezing food products and comprising an insulated housing 10 which contains the essential elements of the apparatus, especially the portions thereof maintained under cryogenic conditions.

Generally, the apparatus can be described and defined as being composed of a central freezing station or zone 12. On the left side of FIG. 1, there is shown entry port 14. On the right side of FIG. 1, there is shown an exit tunnel 16 extending upwardly to exit port 17 and to the right from freezing zone 12. Tunnel 16 defines the exit station, mentioned previously. The entire apparatus is illustrated as being positioned at a convenient height above the floor by means of support legs 18.

Associated with the freezing zone 12, there is a cryogen inlet line 20, which connects to cryogen header 22 within the freezing zone 12 and which has plurality of spray nozzles 23.

Also shown in FIG. 1 are low and high speed conveyors 30 and 32 comprising drive belts 34 and 36, respectively which follow an endless path about idler wheels 38 and drive wheels 40. Low speed conveyor 30 is located through the length of freezing station 12 so that idler wheel 38 of conveyor 30 is slightly above drive wheel 40 of high speed conveyor 32. An article on low speed conveyor 30 falls on to high speed conveyor 32. Ramp 42 or third conveyor is positioned between this transition zone between low and high speed conveyors to prevent breakage or other disorientation of the article. This transition is necessary in the freezing of delicate food products for which the embodiment illustrated in FIG. 1 is particularly adapted. Because of the necessity of food freezers being periodically shut down for a thorough cleaning, there may be no particular advantage for entry port 14 being at a higher elevation than freezing section 12 as in the embodiment illustrated in FIG. 2.

Figure 2:
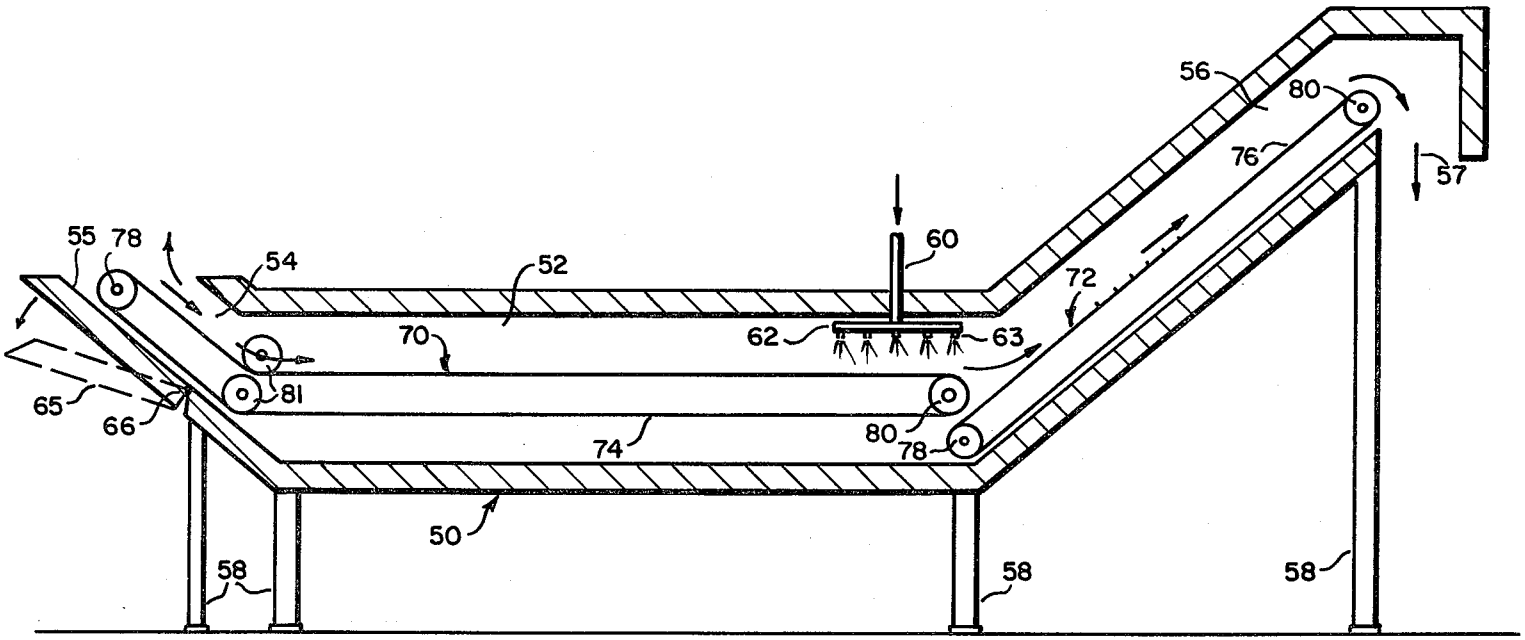
FIG. 2 is a side view of another embodiment of the apparatus.

Referring now to FIG. 2, insulated freezer housing 50 comprises freezing tunnel 52, entry tunnel 54, entry port 55, exit tunnel 56 and exit port 57 mounted on supports 58. It will be seen that exit port 57 is disposed vertically higher than is entry port 55. It will be further noted that both of the ports 55 and 57 are also at a greater height than is freezing tunnel 52. This configuration of the apparatus provides a "well" within housing 10 for the collection of cryogen admitted into freezing tunnel through cryogen inlet 60, header 62 and nozzles 63. Further, due to the fact that exit port 57 is at a greater elevation than is entry port 55, the flow of cryogen is from freezing tunnel 52 into entry tunnel 54 and thence spills out of the housing 50 through entry port 55. This ensures a positive flow of cryogen in that direction thereby precooling the articles to be frozen as they enter the housing 50 through entry tunnel 54. The height that exit port 57 is above entry port 55 can be adjusted by raising or lowering lower sidewall 65 of entry tunnel 54 about hinge 66. This will permit one to adjust the flow of cryogen so that a small spill over of cryogen at exit 57 can be stopped by a slight increase in the angle of sidewall 65.

Low and high speed conveyors 70 and 72 comprise drive belts 74 and 76, respectively on idler wheels 78 and drive wheels 80. Additionally, low speed conveyor 74 is equipped with idler wheels 81 to cause belt 74 to conform to the change in angle from the entry to the freezing tunnel.

The freezer shown in FIG. 2 is particularly adapted to freezing of plastics, scrap tires and other non-food products which do not require routine shutdowns for cleaning. Therefore, in emergency shutdowns, warm moist air is prevented from entering the freezer because of the blanket of cold, dense cryogen gas in the "well".

It is obvious that modifications can be made to the freezers depicted in FIGS. 1 and 2 such as included circulating fans. However, the novel design of the present apparatus avoids unnecessary blowing equipment or air locks to produce the countercurrent flow of cryogen.

What is claimed is:

1. An apparatus for cryogenically freezing an article which comprises, (a) a housing including an entry port at one end thereof, a freezing station, an exit tunnel, and an exit port at the other end thereof and communicating between the exit tunnel and the exterior of the housing, said freezing station positioned intermediate said entry port and said exit tunnel, said exit tunnel extending from said freezing station upwardly to said exit port, (b) cryogen inlet means for introducing a cryogen into said freezing station, and (c) means for transporting the article to be frozen sequentially from the entry port, through the freezing station and the exit tunnel to the exit port, said freezing station being maintained at a cryogenic temperature and said exit port being at a sufficiently greater vertical elevation than said entry port and said freezing station to establish countercurrent flow of the cryogen relative to the movement of the article from said cryogen inlet means to said entry port.

2. The apparatus of claim 1 wherein the means for transporting is capable of increasing the rate of the article traveling through said exit station over the rate through said freezing station.

3. The apparatus of claims 1 or 2 wherein the article is a food product.

4. The apparatus of claim 2 wherein the means for transporting comprises a combination of a low speed conveyor for transporting the article from said entry port through said freezing section and a higher speed conveyor for transporting the article through said exit station to said exit port.

5. An apparatus for cryogenically freezing an article which comprises, (a) a housing including an entry tunnel, an entry port at one end thereof and communicating between the entry tunnel and the exterior of the housing, a freezing tunnel, an exit tunnel, and an exit port at the other end thereof and communicating between the exit tunnel and the exterior of the housing, said freezing tunnel positioned intermediate said entry tunnel and said exit tunnel station, said entry tunnel extending upwardly to said entry port, said exit tunnel extending from said freezing tunnel upwardly to said exit port, (b) cryogen inlet means for introducing a cryogen into said freezing tunnel, and (c) means for transporting the article to be frozen sequentially from the entry port, through the entry tunnel, the freezing tunnel, and the exit tunnel to the exit port at a rate of travel which increases as the article is being transported through the exit tunnel, said freezing tunnel being maintained at a cryogenic temperature and said exit port being at a sufficiently greater vertical elevation than said entry port and said freezing tunnel to establish countercurrent flow of the cryogen relative to the movement of the article from said cryogen inlet means to said entry port and both of said entry port and said exit port being at a greater vertical elevation than said freezing tunnel to provide a well within said housing for the collection of the cryogen to prevent warm, moist air from entering said freezing tunnel.

6. The apparatus of claim 5 wherein the vertical elevation of the entry port below that of the exit port can be adjusted.

7. The apparatus of claim 5 or 6 wherein the article is a non-food product.

8. The apparatus of claim 5 wherein the means for transporting comprises a combination of a low speed conveyor for transporting the article from said entry port through said entry and freezing stations and a higher speed conveyor for transporting the article through said exit station to said exit port.

* * * * *